US008784615B2

(12) United States Patent
Straub et al.

(10) Patent No.: US 8,784,615 B2
(45) Date of Patent: Jul. 22, 2014

(54) PERFORATED FILM CLOTHING HAVING A TEAR-RESISTANT EDGE

(71) Applicant: Voith Patent GmbH, Heidenheim (DE)

(72) Inventors: Michael Straub, Steinheim (DE); Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/939,618

(22) Filed: Jul. 11, 2013

(65) Prior Publication Data

US 2013/0299114 A1 Nov. 14, 2013

Related U.S. Application Data

(63) Continuation of application No. PCT/EP2011/073735, filed on Dec. 22, 2011.

(30) Foreign Application Priority Data

Jan. 11, 2011 (DE) ..... 10 2011 002 498

(51) Int. Cl.
*D21F 1/10* (2006.01)

(52) U.S. Cl.
USPC ..... 162/348; 162/903; 428/131

(58) Field of Classification Search
CPC ..... D21F 1/0063; D21F 1/0027; D21F 1/10; B32B 3/266
USPC ..... 162/116, 348, 358.2, 358.4, 306, 361, 162/362, 900–904; 428/131–140
See application file for complete search history.

(56) References Cited

U.S. PATENT DOCUMENTS

| | | | | |
|---|---|---|---|---|
| 1,663,298 | A * | 3/1928 | Geer et al. | 210/498 |
| 2,287,122 | A * | 6/1942 | Norris | 205/73 |
| 2,659,958 | A | 11/1953 | Johnson | |
| 3,121,660 | A * | 2/1964 | Hall, Jr. | 162/348 |
| 3,323,226 | A * | 6/1967 | Beaumont et al. | 34/95 |
| 3,399,111 | A * | 8/1968 | Beaumont et al. | 162/199 |
| 3,523,867 | A * | 8/1970 | MacBean | 162/348 |
| 4,541,895 | A | 9/1985 | Albert | |
| 6,030,503 | A * | 2/2000 | Matuschczyk | 162/358.4 |
| 6,503,602 | B1 * | 1/2003 | Crosby | 428/193 |
| 7,927,462 | B2 * | 4/2011 | Scherb et al. | 162/358.3 |
| 2010/0230064 | A1 | 9/2010 | Eagles et al. | |

FOREIGN PATENT DOCUMENTS

| | | |
|---|---|---|
| CA | 1 230 511 | 12/1987 |
| GB | 1 037 003 A | 7/1966 |

OTHER PUBLICATIONS

Notification of Transmittal of Translation of the International Preliminary Report of Patentability and Written Opinion of the International Searching Authority dated Jul. 16, 2013, for International Application No. PCT/ EP2011/073735 (8 pages).
International Search Report dated Feb. 9, 2012 for International Application No. PCT/EP2011/073735 (4 pages).

* cited by examiner

*Primary Examiner* — Eric Hug
(74) *Attorney, Agent, or Firm* — Taylor IP, P.C.

(57) ABSTRACT

A clothing for a paper machine is configured as a film-shaped continuous band that is closed in the circumferential direction and that has a perforated useful area and at least one edge extending between the useful area and a lateral edge. The edge area has a perforation density lower than the perforation density of the useful area.

8 Claims, 5 Drawing Sheets

PERFORATED FILM CLOTHING HAVING A TEAR-RESISTANT EDGE

CROSS-REFERENCE TO RELATED APPLICATIONS

This is a continuation of PCT application No. PCT/EP2011/073735, entitled "PERFORATED FILM CLOTHING HAVING A TEAR-RESISTANT EDGE", filed Dec. 22, 2011, which is incorporated herein by reference.

BACKGROUND OF THE INVENTION

1. Field of the Invention

The current invention relates to clothing for paper machines and, in particular to, nonwoven clothing for the support and transport of a fibrous web in paper machines.

2. Description of the Related Art

Paper machines serve to produce fibrous webs, for example paper webs of various types, cartons, cardboards and similar nonwoven materials. The term "paper" is used in this documentation as being representative for these types of fibrous webs.

The production of a fibrous web begins in the forming section of a paper machine by bringing a fibrous stock suspension onto clothing or, respectively, by introducing a fibrous stock suspension into the gap which is formed between two layers of clothing. Clothing is normally in the embodiment of continuous belts which rotate always within a certain section of the paper machine, turned over rollers. The paper-side surface of the clothing carries the fibrous stock suspension or, respectively, the fibrous or nonwoven web created by the suspension. In the following description the surface of the clothing running over the rollers is referred to as the running side. The clothing has passages for dewatering through which the water can be sucked from the paper side toward the running side.

The clothing in the embodiment of forming fabrics which are currently used in the forming section of paper machines consists of woven material. Woven clothing, due to its uniform weave structure, frequently leads to undesirable marking in the paper web and due to its low flexural rigidity tends to wrinkle during rotation in the paper machine. Moreover, the woven seam of woven clothing in the embodiment of a continuous belt is extremely complex and cost-intensive. There is therefore a requirement for alternative clothing.

As an alternative to woven clothing, clothing was suggested that is produced from film-like nonwoven material. A clothing is cited, for example, in patent documents CA 1 230 511 and U.S. Pat. No. 4,541,895 which is formed from a laminate consisting of several layers of nonwoven water-impermeable materials into which openings for dewatering were introduced. Interconnection of the individual laminate layers occurs flat through, for example ultrasonic welding, high frequency welding or thermal welding. The dewatering apertures are created in the laminate preferably by means of laser drilling.

In patent application publication US 2010/0230064 a film-like clothing produced from a spirally wound polymer belt for use in paper machines is suggested. The width of the polymer belt is substantially less than the width of the clothing produced thereof, whereby the longitudinal direction of the polymer belt—with the exception of the tilt caused by the winding height—is consistent with the direction of travel of the clothing. The lateral edges of adjacent winding sequences of the polymer belt respectively located opposite each other are welded together to create a closed running surface. The clothing moreover has apertures through which air and/or water can move from one surface of the clothing to the other.

To avoid undesirable markings on papers the clothing must have homogeneous water permeability in those regions where they transport the fibrous web. With film-like clothing, aperture patterns are required wherein apertures having diameters in the range of approximately 50 to 250 micrometers (μm) are distributed at approximately even distances. An appropriate perforation however causes a weakness in the mechanical strength of the film-like clothing which can lead to tearing, in particular at the heavily stressed lateral edges.

In a known method the edges of woven forming fabrics are welded together through ultrasonic welding or thermal energy, possibly also strengthened with additives, for example polyurethane, so that the edges do not tear during rotation in the paper machine. Due to the lack of a woven structure whose threads can be joined with each other through welding and whose pores can be filled with additives, these methods of edge strengthening cannot be transferred to film-like clothing.

What is needed in the art is an edge configuration for film-like clothing for use in a paper machine which offers high reliability in the prevention of tearing of the clothing edge, while being utilized as intended.

SUMMARY OF THE INVENTION

The present invention provides a number of embodiments of clothing for a paper machine, wherein the clothing is a film-like continuous belt that is closed in the direction of rotation, that has a perforated usable region and at least one edge region extending between the usable region and one lateral edge, and whereby the edge region has a lower perforation density compared to the usable region.

The film-like continuous belt is to be understood to be a belt which is limited in its width by two lateral edges located opposite each other, and in a direction parallel to the two lateral edges is closed onto itself and is in the embodiment of a thinner monolithic body compared to its lateral extensions. Laminates are also considered monolithic bodies in this context. The usable region is understood to be that part of the clothing where formation and sheet formation of the fibrous web occur. Perforation density is understood to be the ratio of the cross sectional area of the pores on the paper side surface of the clothing relative to the total surface over a respective reference region. This term is often also referred to as porosity.

Moreover it is pointed out that the terms used in this description and in the claims in referring to characteristics such as "comprise", "have", "include", "contain" and "with" as well as grammatical variants thereof are generally to be understood as non-limiting in listing of properties, for example process steps, devices, locations, sizes, etc. and do not in any way exclude the presence of other or additional properties or groupings of other or additional properties.

Arrangements of the aforementioned embodiments have at least one pore-free edge region, whereby an especially stable and tear-resistant clothing edge is created. As a result, the edge region compared to edge regions having higher porosities can be narrower, for example can have a width of 30 millimeters (mm) or less.

In other arrangements the at least one edge region has pores which are arranged in rows of apertures extending at constant distances in the direction of rotation, and whereby the distance of the aperture rows to each other and to the perforated usable region of the clothing is greater than the distance between the aperture rows in the perforated usable region of the clothing, extending in the direction of rotation of the clothing. The lower mechanical strength of the edge region in this arrangement compared to the pore-free edge permits compensation of different tensile stresses between usable- and edge regions of a clothing through limited warping of the edge region, so that no wrinkling occurs within the perforated usable region.

In order to obtain maximum tear-resistance in spite of this, the distance between the lateral edge of the clothing and the row of apertures in the edge region located most closely adjacent to it is advantageously consistent with at least the distance from this row of apertures to the row of apertures located most closely adjacent to it.

Other arrangements of the clothing for a paper machine according to the present invention show a distance between a row of apertures located in the edge region and the row of apertures located most closely adjacent to it in the direction of the lateral edge, which is greater than the distance to the row of apertures located most closely adjacent to this row of apertures in the direction of the perforated usable region. These arrangements permit an incremental or gradual increase of the mechanical stability of the edge region in the direction of the lateral edge defining the edge region.

Another possibility for increasing the mechanical stability of the edge region in the direction of the lateral edge defining the edge region exists in that at least one row of apertures disposed in the edge region has a lower density of apertures than the row of apertures located most closely adjacent to it in the direction of the perforated usable region of the clothing.

So warping caused by differences in the tension between the edge region and the usable region of the clothing does not continue to the lateral edge, the distance between the lateral edge of the clothing and the edge region's row of apertures located most closely adjacent to it is greater than the distance of this row of apertures to the row of apertures located most closely adjacent to it.

The mechanical stability of the edge region can also be influenced by the choice of cross sectional geometry of the pores disposed therein. Embodiments of the previously discussed porous edge regions therefore have rows of apertures with holes that have a different cross sectional geometry than the pores in the perforated usable region. An additional arrangement option is obtained through variations in the orientation of the cross sectional geometry of the apertures disposed in the edge region. Some embodiments of the clothing according to the present invention therefore show an orientation of the cross sectional geometries of the apertures in at least one of the rows of apertures disposed in the edge region, which differs from the orientations of the cross sectional geometries of the apertures in other rows of apertures. Moreover, or in addition, cross sectional geometries of the apertures within one row of apertures disposed in the edge region can be oriented differently.

In addition to the previously discussed properties, the edge region of the clothing is thicker in other arrangements than the perforated usable region. This can be implemented either through the production of the continuous belt or through application of a belt-like edge overlay.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
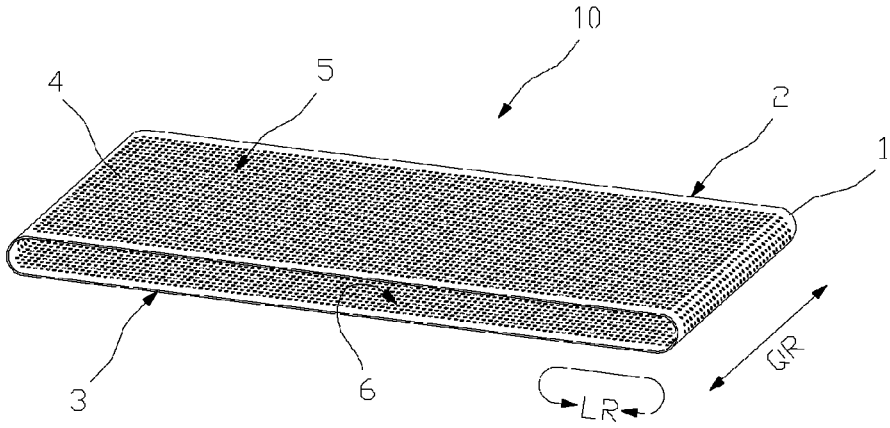
FIG. 1 is a schematic illustration of a perforated clothing according to the present invention.

Referring now to the drawings, and more particularly to FIG. 1, there is shown a schematic illustration of perforated clothing 10. The perforated clothing consists of a belt 1 which is defined in its width by two lateral edges 2 and 3. In the direction parallel to lateral edges 2 and 3, belt 1 is closed onto itself and is therefore described as a continuous belt. Clothing 10 has a paper-side surface 5 on which the fibrous stock suspension or respectively the fibrous web being formed therefrom is supported in intended use of clothing 10. Paper-side surface 5 of clothing 10 is the surface of clothing 10 facing outward in the drawing. The surface directed inward, facing the volume enclosed by clothing 10 is identified as running side 6 in this document. It is supported on the rolls (not illustrated in the drawings), which effect the rotation of clothing 10.

The direction in which the continuous belt is closed onto itself is referred to as the direction of travel LR, or direction of rotation LR of continuous belt 1 or clothing 10; the direction along the shortest connection between the two lateral edges 2 and 3 is referred to as cross direction QR. The directions pointing from the running side to the paper-side surface of clothing 10 are referred to below as vertical direction of clothing 10 or respectively of continuous belt 1.

To create porous clothing 10, a multitude of apertures 4 are disposed on continuous belt 1. As can be seen in the schematic illustration of a cross section through a segment of continuous belt 1 shown in FIGS. 2*a* and 2*b*, each one of apertures 4 forms a passage from paper-side surface 5 of continuous belt 1 to running surface 6. These apertures which provide the openings are also referred to as pores 4 and serve to dewater a fibrous material which is supported on the belt during the production of paper. Apertures 4 may, for example, be created in clothing 10 through laser drilling or other suitable methods.

Figure 2A:
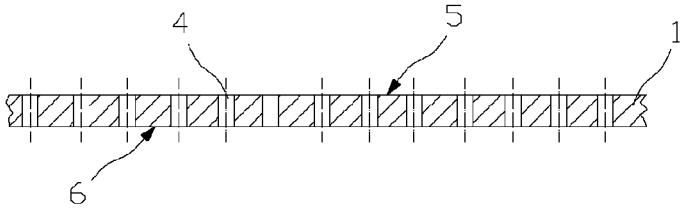
FIG. 2*a* is a schematic illustration of a cross section through a segment of the perforated film clothing of FIG. 1 with pores having uniform cross sections.
Figure 2B:
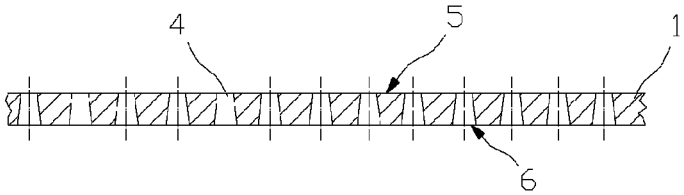
FIG. 2*b* is a schematic illustration of a cross section through a segment of the perforated film clothing of FIG. 1 having conical pores.

The aperture shapes of pores 4 can—as illustrated in FIG. 2*a*—have a cross section which does not change between surfaces 5 and 6 of belt 1, but can also have a cross section—as shown in FIG. 2*b*—which expands in the direction toward rear side running surface 6 which is not used to support the fibrous web. In special clothing, the pore cross section may also taper toward the running surface. With round cross-sectional shapes, cylindrical or conical aperture shapes result therefore. In addition to pores having round cross sectional geometries, pores having elliptical cross sections can also be used in some embodiments of clothing 10. Moreover, pores 4 can be configured as an elongated hole or slot, or having any desired cross section, for example triangular, rectangular, star-shaped or other geometries.

In the clothing illustrated in FIG. 1, the edge regions of clothing 10 do not have any pores in order to minimize the probability of tearing of belt 1 at the lateral edges during intended use. The width of the non-perforated lateral edge zones is, for example in the range of between 5 and 100 millimeters (mm) or in the range of between 10 and 50 mm.

Figure 3:
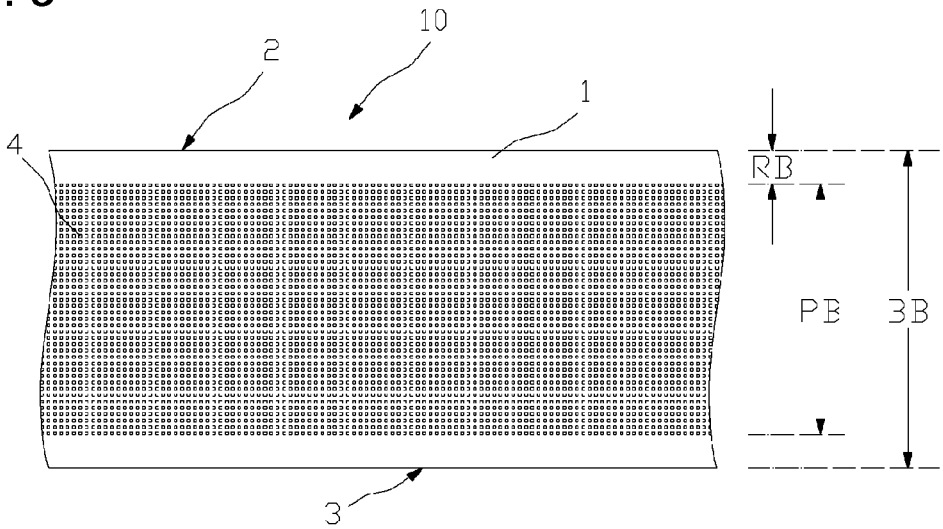
FIG. 3 is a schematic illustration of the perforated clothing of FIG. 1 with pore-free edges.

The schematic depiction in FIG. 3 illustrates a section of clothing 10 as shown in FIG. 1. Clothing 10 extends with a belt width BB between the two lateral edges 2 and 3. The region of clothing 10 in which pores 4 are disposed is narrower than the total width BB of clothing 10, so that between porous region PB and lateral edges 2 and 3 always a non-porous edge zone RB is formed. In the embodiment of a perforated film clothing illustrated in FIG. 3, the porous region between lateral edges 2 and 3 is centered, so that both edge zones are of the same width. The width of the porous region of clothing 10 is consistent with belt width BB, minus the two edge widths. Number, shape, size and arrangement of pores 4 in FIG. 3, as well as clothing width BB and the widths of porous region PB and edge region RB are selected solely with a view of a clear illustration and are not to be regarded as an illustration of a clothing that is to scale. This applies also to the other drawings.

Figure 4:
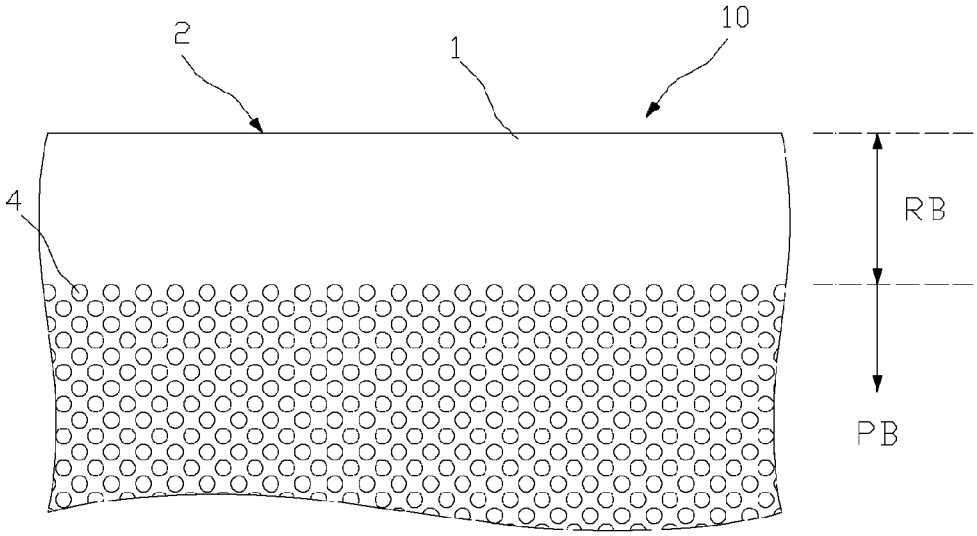
FIG. 4 is a schematic illustration of a sectional view of a non-perforated edge region located adjacent to the perforated usable region of the film-like clothing of FIG. 1.

Referring now to FIG. 4, there is shown one of edge regions RB in one design variation of clothing 10. In this arrangement, perforated region PB ends abruptly at edge zone RB, whereby the width of the edge zone can be relatively narrow, for example 30 mm or narrower and whereby a wide usable region for sheet formation relative to the clothing width BB is obtained.

Figure 5:
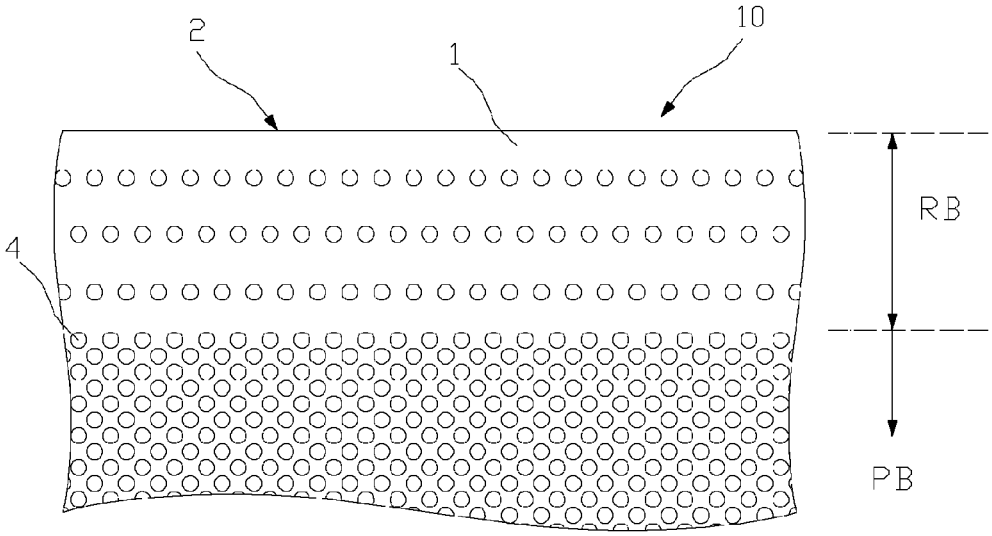
FIG. 5 is a schematic illustration of a sectional view according to a first arrangement of a perforated edge region, located adjacent to the perforated usable region of the film-like clothing of FIG. 1.

Another embodiment of clothing 10 with an edge zone is illustrated in FIG. 5. In this arrangement, perforations are disposed also in the edge zone. The perforation in the edge zone is in the form of several rows of apertures, whereby the distances between the rows of apertures are constant and, as is the case in the illustrated embodiment are also consistent with the distance from the respective outside row of apertures to the perforated region or respectively to outside lateral edge 2. The distance between the rows of apertures of the edge zone is thereby greater than the distance between the rows of apertures of perforated region PB of clothing 10, or in other words, the rows of apertures in the edge zone are arranged at a lower density than in perforated clothing region PB. Since the rows of apertures weaken the mechanical stability of the edge zone, the edge zone is wider compared to the edge zone of the embodiment according to FIG. 4, having a width for example in the range of 30 to 40 mm. The number of rows of apertures in edge zone RB is selected in the drawing as well as in subsequent drawings only with a view to providing a clear illustration of the principle of the edge arrangement and is not to be confused with that of an actual arrangement.

Figure 6:
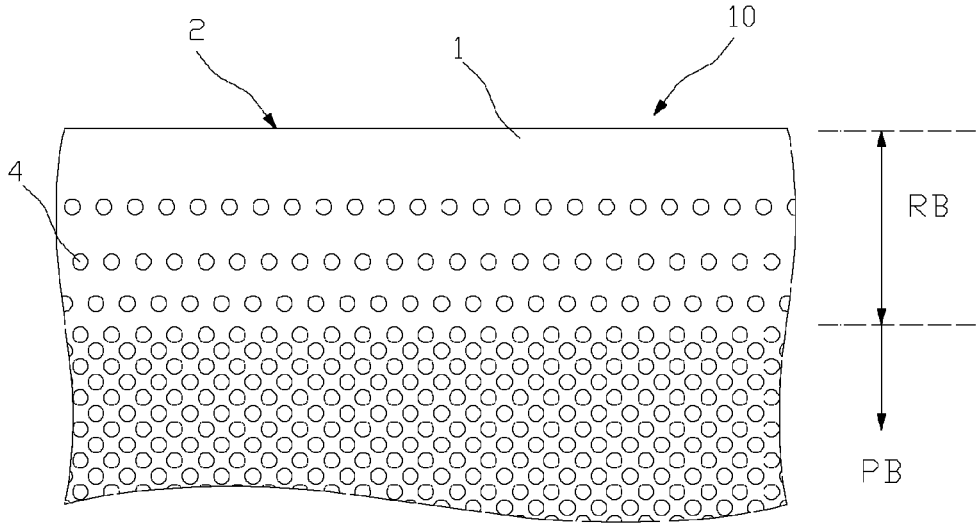
FIG. 6 is a schematic illustration of a sectional view according to a second arrangement of a perforated edge region, located adjacent to the perforated usable region of the film-like clothing of FIG. 1.

Referring now to FIG. 6, there is shown an additional example for an edge arrangement of a porous film clothing 10. As shown in the example according to FIG. 5, edge zone RB also shows several rows of apertures in this example, whose distance to the respective adjacent rows of apertures is greater than that of the rows of apertures within the perforated region PB. In contrast to other embodiments, according to FIG. 6, the distance of the rows of apertures becomes increasingly greater in the edge zones in the direction toward the lateral edges, whereby in some of the arrangements as shown in FIG. 6, in particular the distance between the outer row of apertures and lateral edge 2 or 3 is selected in view of a high tear resistance to be greater than the greatest distance between rows of apertures of the edge zone.

Figure 7:
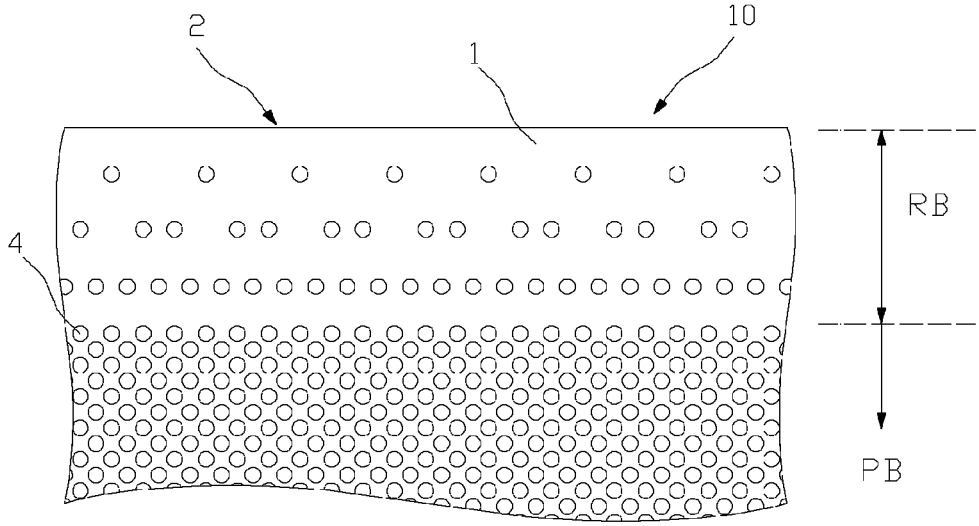
FIG. 7 is a schematic illustration of a sectional view according to a third arrangement of a perforated edge region, located adjacent to the perforated usable region of the film-like clothing of FIG. 1.

One example for an alternative configuration to the embodiment symbolized by FIG. 5, is shown in FIG. 7. The distance between the rows of apertures in the edge zone and if applicable to the edges of the edge zone are constant. However, the density of the apertures per aperture row decreases toward respective lateral edge 2 or 3, whereby this can occur by omitting apertures as illustrated in FIG. 7, as well as by changing the distance between the apertures from row to row, whereby in the latter case, the distances between the pores within one row of apertures is kept constant.

Figure 8:
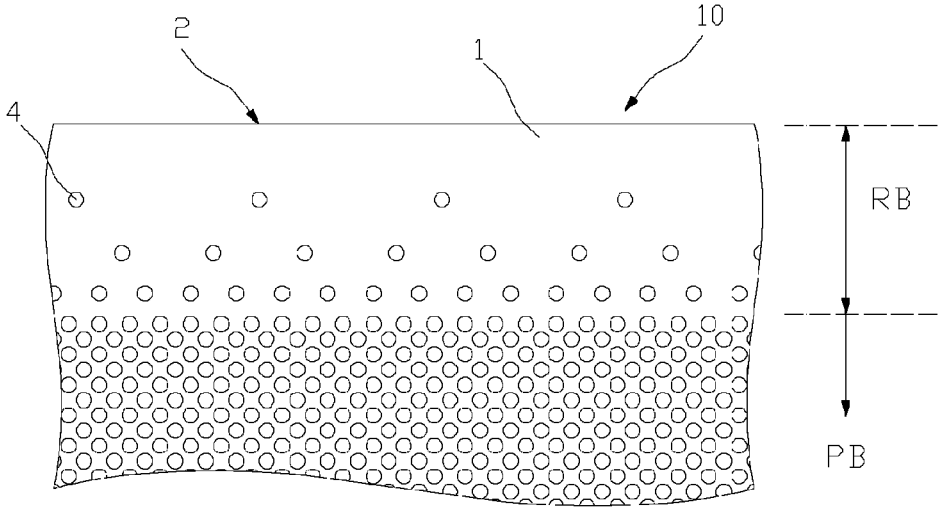
FIG. 8 is a schematic illustration of a sectional view according to a fourth arrangement of a perforated edge region, located adjacent to the perforated usable region of the film-like clothing of FIG. 1.

Referring now to FIG. 8, there is shown an additional possibility for the formation of an edge zone of film-like clothing 10. In the embodiment illustrated in this drawing, the distances between adjacent rows of apertures increase in the edge zone in the direction toward lateral edge 2 or 3, as well as also the distances between the apertures within the rows of apertures.

Figure 9:
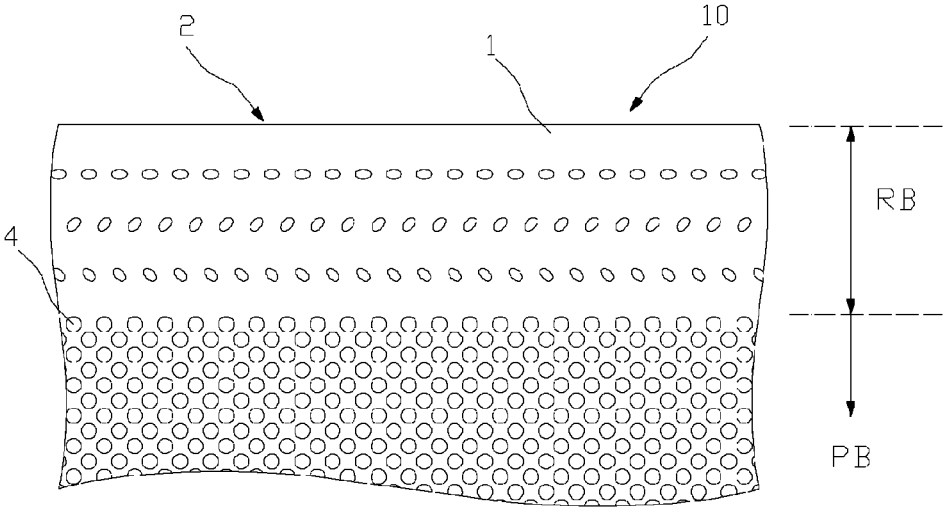
FIG. 9 is a schematic illustration of a sectional view according to a fifth arrangement of a perforated edge region, located adjacent to the perforated usable region of the film-like clothing of FIG. 1.

FIG. 9 illustrates one variation of the embodiment according to the illustration in FIG. 5. Pores 4 of edge zone RB have different pore geometries than pores 4 of porous region PB, whereby the orientation of the aperture geometries as indicated, can change from row to row, in order to advantageously influence, for example the tension progression between lateral edges 2 and 3 and porous region PB.

The described edge arrangements permit the creation of a perforated film clothing with an edge region which has a greater mechanical stability and tear resistance than the perforated usable region between edge zones RB and thereby provides increased resistance for edge sensors and edge guide systems as well as edge lifters. The formation of the described rows of apertures in the edge zone further enables a gradual transition of the strength from the solid lateral edge region to the region of maximum porosity at the edge of the porous region PB of film clothing 10.

In additional embodiments the edge zone on lateral edge 2 is arranged differently than lateral edge 3, in order to optimize the respective edge zone to its specific load in the paper machine. This is particularly advantageous if certain devices, for example the aforementioned edge lifters, edge guide systems or edge sensors are arranged respectively always only on one side of film clothing 10.

In the previously discussed edge arrangements, the thickness of clothing 10 in edge zone RB is consistent with the thickness of clothing 10 in porous region PB. In alternative embodiments thereto, one or both edge zones RB have a thickness that is different than the thickness of the porous region, whereby the thickness of edge region RB can change from porous region PB of clothing 10 toward lateral edge 2 or 3.

In the simplest case a film-like polymer belt 8 is laminated for this purpose onto the edge zone(s) of substrate film 7 of clothing 10. This can occur through flat transmission laser welding, ultrasonic welding, thermal welding or bonding. In transmission laser welding for example, transparent polymer belt 8 which is transparent for the laser wave length of the welding apparatus is applied to the edge zones of substrate film 7. If the material of substrate film 7 is also transparent for the used laser wave length, at least one coating which absorbs the laser light is applied onto one of the surfaces of edge overlay or substrate contacting each other. The laser light that is radiated through edge overlay 8 or possibly substrate film 7 is absorbed by the coating or on the surface of the non-transparent film 7 or 8, whereby it melts and under pressure bonds with the material surface in contact with it. For flat welding the laser beam is expanded linearly, either through suitable optics or through rapid reciprocal movement of a scattered beam. By moving clothing 10 relative to the laser beam, a linear bonding zone can be directed over the edge zone, thereby creating a flat bonding of polymer edge overlay 8 and substrate film 7 of clothing 10.

Figure 10:
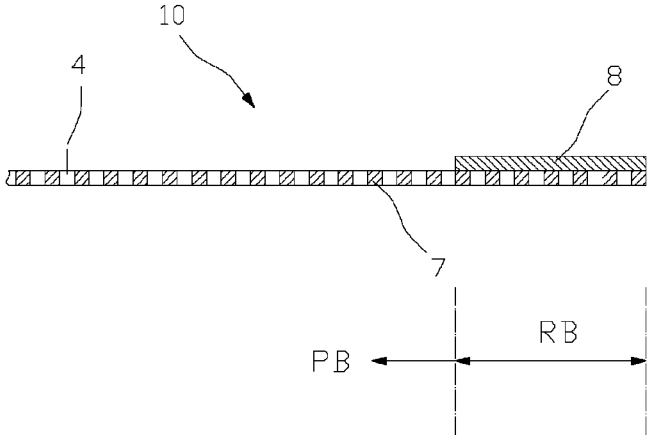
FIG. 10 is a schematic illustration of a cross section through the film-like clothing of FIG. 1 in the area of a reinforced edge region according to an embodiment of the present invention.

The edge region of a thus produced clothing 10 is illustrated schematically in FIG. 10. Clothing 10 shows film substrate 7 that is perforated into edge zone RB. Film-like edge overlay 8 is applied to edge region RB which covers apertures 4 of substrate film 7 beneath it.

Figure 11:
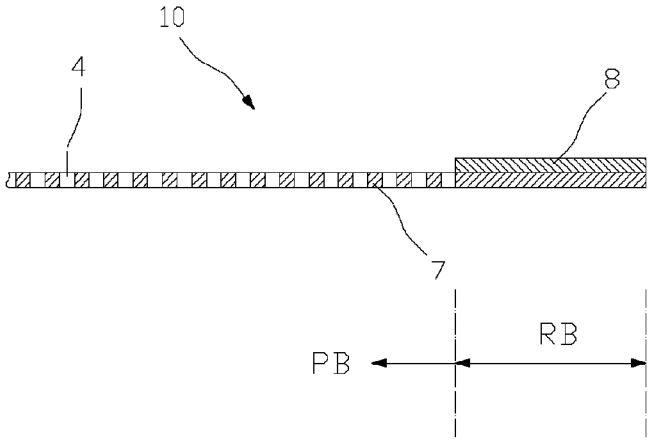
FIG. 11 is a schematic illustration of a cross section through the film-like clothing of FIG. 1 in the area of a reinforced edge region according to another embodiment.
Figure 12:
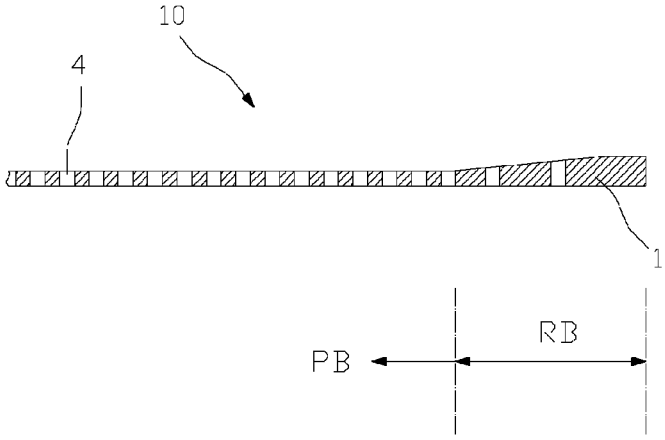
FIG. 12 is a schematic illustration of a cross section through the film-like clothing of FIG. 1 in the area of a reinforced edge region according to another embodiment of the present invention.

FIG. 11 illustrates an alternative edge arrangement wherein no apertures 4 are arranged in film substrate 7 beneath belt-like edge overlay 8. An additional embodiment of a porous clothing 10 with edge thickening is shown in FIG. 12, wherein the clothing is in the embodiment a continuous belt whose thickness increases toward the lateral edge. The increase in thickness may occur in increments or, as for example illustrated in the, drawing gradually. To create this type of edge thickening, continuous belt 1 of clothing 10 is produced from an extruded semi-finished product by drawing.

The layout of the rows of apertures in the arrangements according to the principles illustrated in FIGS. 10 and 12 can be configured according to one of the principles or combinations thereof illustrated in FIGS. 4 through 9. Naturally, edge overlay 8 illustrated in FIGS. 10 and 11 can also have a thickness profile in the cross direction of clothing 10.

In order to improve the service life of the edge-side high wear zone, the thickness profile according to FIGS. 10 through 12 can also be arranged on the machine side of clothing 10. Moreover it is conceivable to provide clothing 10 with an abrasion resistant coating in the edge region that can consist of a polymer resin such as polyurethane. Apertures 4 which are thinning out in this area can hereby also be closed or partially closed.

A clothing for paper machines having an edge arrangement as previously described has a high mechanical stability and offers secure protection against tearing of the clothing edges during intended use of the clothing.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A clothing for a paper machine, the clothing comprising:

a film-like continuous belt closed in a direction of rotation, said continuous belt having a perforated usable region and at least one edge region extending between said perforated usable region and a lateral edge of said continuous belt, said at least one edge region having a lower perforation density compared to said perforated usable region, wherein said at least one edge region has a plurality of pores arranged in a plurality of rows of apertures extending at constant distances in said direction of rotation, said constant distance of said aperture rows to each other and to said perforated usable region of the clothing is greater than a distance between said aperture rows of said perforated usable region of the clothing extending in said direction of rotation of the clothing.

2. The clothing according to claim 1, wherein a distance between said at least one lateral edge of the clothing and a first row of apertures directly adjacent said at least one lateral edge is consistent with at least a distance from said first row of apertures and a second row of apertures located most closely adjacent to said first row of apertures.

3. The clothing according to claim 1, wherein a distance between a first row of apertures located in said at least one edge region and second row of apertures located most closely adjacent said first row of apertures in a direction of said at least one lateral edge is greater than a distance to a third row of apertures most closely adjacent to said second row in a direction of said perforated usable region.

4. The clothing according to claim 3, wherein at least one row of apertures disposed in said at least one edge region has a lower density of apertures than another row of apertures located most closely adjacent said at least one row of apertures in said edge region in said direction of said perforated usable region of the clothing.

5. The clothing according to claim 3, wherein a distance between said at least one lateral edge of the clothing and said first row of apertures located most closely to said at least one lateral edge in said at least one edge region is greater than a distance between said first row of apertures to a second row of apertures located most closely adjacent to said first row of apertures.

6. The clothing according to claim 1, wherein a plurality of apertures in said plurality of rows of apertures located in said at least one edge region have a different cross sectional geometry than a plurality of pores in said perforated usable region.

7. The clothing according to claim 6, wherein an orientation of said cross sectional geometries of a plurality of apertures in at least one row of said plurality of rows of apertures located in said at least one edge region is different from an orientation of said cross sectional geometry of a plurality of apertures in a plurality of other of said plurality of rows of apertures.

8. The clothing according to claim 6, wherein said cross sectional geometries of a plurality of apertures within one of said plurality of rows of apertures located in said at least one edge region are oriented differently.

* * * * *